US005120203A

United States Patent [19]

Priestly

[11] Patent Number: 5,120,203

[45] Date of Patent: Jun. 9, 1992

[54] UNIVERSAL PLUNGER FOR OIL WELL PUMPS

[76] Inventor: Ronald A. Priestly, 508 Neches, White Oak, Tex. 75693

[21] Appl. No.: 604,195

[22] Filed: Oct. 29, 1990

[51] Int. Cl.[5] ..... F04B 21/04; F04B 39/10; F01B 31/00; F16L 25/00

[52] U.S. Cl. ..... 417/554; 417/553; 417/552; 417/545; 92/174; 285/332.2

[58] Field of Search ..... 417/554, 553, 552, 545, 417/547, 448, 449, 450; 92/174, 158, 159; 285/332, 332.2

[56] References Cited

U.S. PATENT DOCUMENTS

| | | | |
|---|---|---|---|
| 530,350 | 12/1894 | Rosenkranz | 417/554 |
| 1,624,798 | 4/1927 | Neilson | 417/545 |
| 1,679,625 | 8/1928 | Penrod et al. | 417/545 |
| 2,234,056 | 3/1941 | Moore | 285/332 |
| 2,342,834 | 2/1944 | Brant | 285/332 |
| 3,075,474 | 1/1963 | Kelley | 417/554 |
| 4,026,583 | 5/1977 | Gottlieb | 285/332.2 |
| 4,841,846 | 6/1989 | Grambling | 92/174 |

*Primary Examiner*—Richard A. Bertsch
*Assistant Examiner*—Alfred Basichas
*Attorney, Agent, or Firm*—John M. Harrison

[57] ABSTRACT

A universal plunger for oil well pumps, which universal plunger includes a symmetrical plunger body having a longitudinal bore, a pair of threaded flange nipples projecting from end flanges located on each end of the plunger body, a pair of spaced O-ring seats provided inwardly of the end flanges, respectively, the O-rings seated in the O-ring seats, a plunger body segment of reduced diameter extending between the inner sets of O-rings and a "Teflon"-hydrocarbon composition disposed between the spaced inside O-rings, the plunger body segment and that portion of the inside surface of the oil well pump barrel which faces the plunger body segment, for sealing and lubricating the universal plunger in the pump barrel.

7 Claims, 1 Drawing Sheet

UNIVERSAL PLUNGER FOR OIL WELL PUMPS

BACKGROUND OF THE INVENTION

1. Field of the Invention

This invention relates to insert pumps and tubing pumps for pumping oil from an oil well and more particularly, to a universal plunger for reciprocation inside the pump barrel of the insert pumps and tubing pumps. The universal plunger is characterized by outstanding sealing characteristics which are facilitated by the use of a polytetrafluorethylene-hydrocarbon composition seal located in the pump barrel between spaced O-rings seated on the universal plunger. The suspended polytetrafluorethylene or "Teflon" (trademark of DuPont) component of the sealing lubricant operates to coat the inside surface of the pump barrel and thereby seal the pump barrel and universal plunger against "blow back" of production fluid during pumping. The universal plunger body, O-rings and inside surface of the pump barrel thus define a sealing and lubrication chamber to facilitate highly efficient operation of a tubing or insert pump which incorporates the universal plunger of this invention.

One of the problems which exists in conventional insert and tubing pumps is that of sealing the pump plungers inside the corresponding pump barrels during reciprocation of the plungers inside the barrels. Various types of seals, including O-rings, packing and other seals well known to those skilled in the art, have been used in an attempt to increase the efficiency of the pumping operation and prevent "blow-back" of production fluid. Regardless of the type of seals and packing used to prevent, or at least minimize, this undesirable "blow-back", the pump must be periodically pulled from the well and the seals and/or packing frequently replaced, at great expense in labor and materials.

Accordingly, it is an object of this invention to provide a new and improved, liquid-sealed universal plunger for application to oil field pumps.

Another object of the invention is to provide a new and improved universal plunger for oil well pumps, which universal plunger is characterized by an elongated plunger body having a longitudinal bore and fitted with at least one O-ring on each end and also having a reduced interior body diameter for insertion in the pump barrel and receiving a polytetrafluorethylene "Teflon" resin-oil combination to seal and and lubricate the pump.

Another object of this invention is to provide a universal plunger for use in insert and tubing pumps, which universal plunger is characterized by an elongated plunger body fitted with a set of spaced O-rings on each end and an inner body segment of reduced diameter for fitting in the pump barrels of the pumps and defining a lubrication and sealing chamber for receiving a "Teflon"-hydrocarbon composition to a positively seal the reciprocating universal plunger in the pump barrel.

Still another object of this invention is to provide a universal plunger for replacing the conventional plungers in oil well pumps, which universal plunger includes an elongated plunger having a longitudinal bore and fitted with spaced seals on each end and also having an inner body portion of reduced diameter located between the seals for insertion in the pump barrel and receiving a quantity of hydrocarbon containing "Teflon" in suspension, for lubricating and sealing the universal plunger in the pump barrel.

Another object of this invention is to provide a universal plunger for insertion in the pump barrel of a tubing or insert pump, which universal plunger is characterized by an elongated, hollow pipe having at least one O-ring seal at each end, a threaded nipple projecting from each end and a body portion of reduced diameter located between the spaced O-ring seals, for receiving a quantity of "Teflon"-oil sealing and lubricating composition and retaining the "Teflon"-oil composition in the pump barrel for lubricating and sealing purposes when the universal plunger is reciprocating in the pump barrel.

SUMMARY OF THE INVENTION

These and other objects of the invention are provided in a new and improved universal plunger for reciprocation in the pump barrel of oil well pumps, which universal plunger is characterized in a preferred embodiment, by a dual set of O-rings located at each end thereof in spaced relationship, a threaded nipple projecting from each end of the universal plunger and a body portion of reduced diameter located between the spaced inner O-rings for defining a lubrication chamber when the universal plunger is inserted in the pump barrel, which lubrication chamber is designed to receive a "Teflon" resin-gear oil lubricating and sealing composition for lubricating and sealing the reciprocating universal plunger in the pump barrel during operation of the pump.

BRIEF DESCRIPTION OF THE DRAWING

The invention will be better understood by reference t the accompanying drawing, wherein.

DESCRIPTION OF THE PREFERRED EMBODIMENTS

Figure 1:
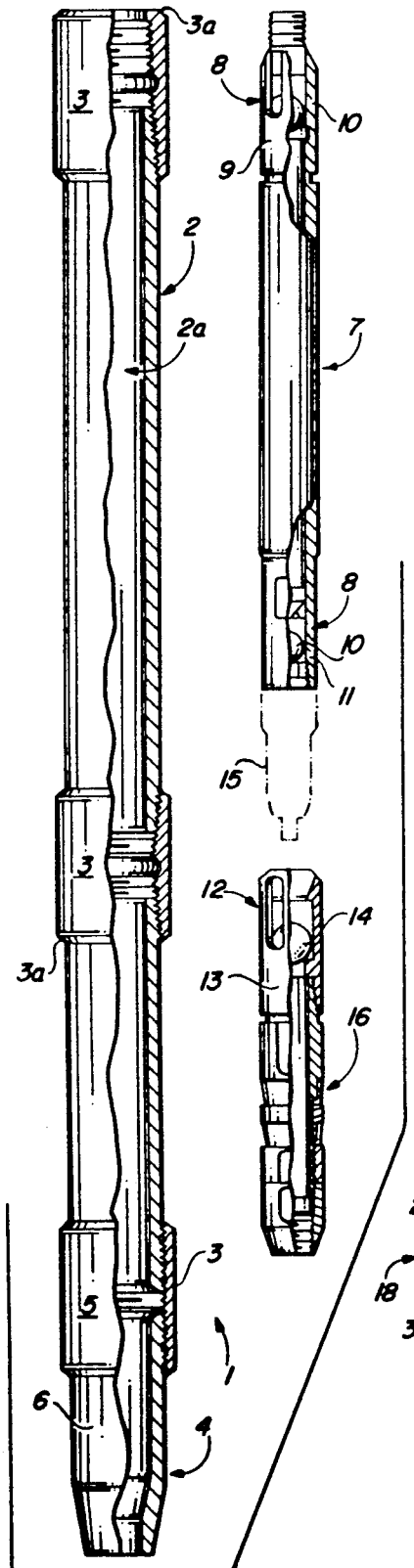
FIG. 1 (PRIOR ART)
FIG. 1 is an exploded view, partially in section, of a conventional prior art tubing pump.

Referring initially to FIG. 1 of the drawing, a typical tubing pump, the design which is well known to those skilled in the art, is generally illustrated by reference numeral 1. The tubing pump 1 is characterized by a cylindrical pump barrel 2, having a longitudinal pump barrel bore **2*a* and fitted with barrel couplings 3 at the top and bottom thereof. The bottom barrel coupling 3 operates to couple an extension nipple 4** to the pump barrel 2 and the extension nipple 4 is further characterized by a tubing coupler 5 and a seating nipple 6. The tubing pump 1 further includes a conventional reciprocating soft packed plunger 7, fitted with a traveling valve 8 at each end, the top traveling valve 8 further including an open-top cage 9, which receives a traveling ball 10. The bottom traveling valve 8 is characterized by a closed plunger cage 11, also having a traveling ball 10 therein and a standing valve puller 15, detailed in phantom, is connected to the lower end of the soft packed plunger 7. A conventional seating cup 16 is designed for insertion in the pump barrel 2 beneath the soft packed plunger 7 and includes a standing valve 12, which includes a standing valve cage 13 and a standing ball 14, located in the standing valve cage 13.

Figure 2:
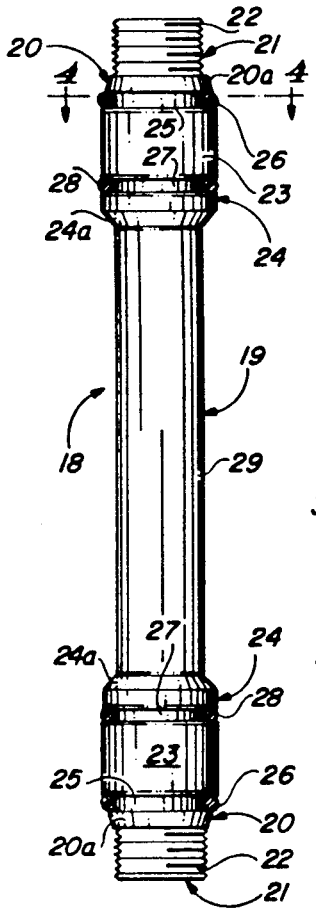
FIG. 2 is a side view, partially in section, of a preferred embodiment of the universal plunger of this invention.
Figure 3:
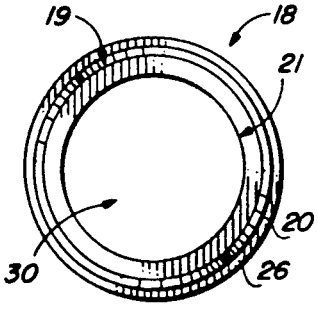
FIG. 3 is a top view of the universal plunger illustrated in FIG. 2.
Figure 4:
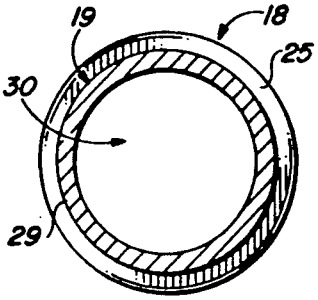
FIG. 4 is a sectional view taken along line 4—4 of the universal plunge illustrated in FIG. 2, with the outside O-ring removed.

Referring now to FIGS. 2–4 of the drawing, the universal plunger of this invention is generally illustrated by reference numeral 18 and is characterized by an elongated plunger body 19 having a longitudinal plunger barrel bore 30, the ends of which plunger body 19 are fitted with tapered end flanges 20, respectively. Flange nipples 21 extend outwardly from the end flanges 20, respectively, and are fitted with nipple threads 22. An outside O-ring seat 25 is located inwardly of each of the end flanges 20 for receiving an outside O-ring 26. A pair of middle flanges 23 are disposed inwardly of the outside O-ring seats 25, respectively, and a pair of inside O-ring seats 27 are disposed inwardly of the middle flanges 23, respectively, for accommodating a pair of inside O-rings 28, as further illustrated in FIG. 2. A pair of inside flanges 24 are disposed inwardly of the inside O-ring seats 27, respectively, and are spaced by a plunger barrel 29 having a diameter less than the end flanges 20, middle flanges 23 and inside flanges 24, respectively. In a most preferred embodiment of the invention the end flanges 20 are provided with an end flange bevel 20*a* and are slightly smaller in diameter than the diameter of the middle flanges 23 and inside flanges 24, to facilitate easy insertion of the universal plunger 18 in the pump barrel bore 2*a* of the pump barrel 2, as hereinafter further described. Accordingly, it will be appreciated by those skilled in the art that the outside O-rings 26 and inside O-rings 28, seated in the respective outside O-ring seats 25 and inside O-ring seats 27 serve to seal and isolate that portion of the plunger barrel 29 of reduced diameter which projects between the inside flanges 24 as the universal plunger 18 reciprocates in the pump barrel bore 2*a* of the pump barrel 2. In a most preferred embodiment of the invention the inside flanges 24 are each provided with an inside flange bevel 24*a*, which extend to the plunger barrel 29, respectively.

Figure 5:
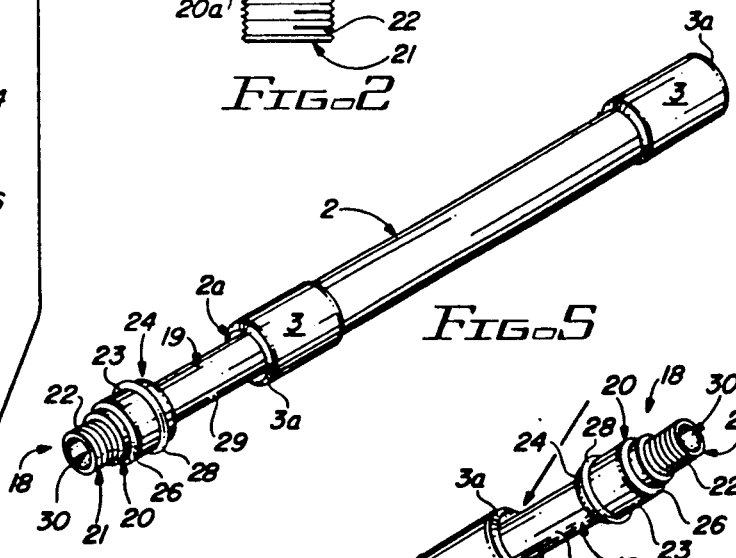
FIG. 5 is a perspective view of the tubing pump barrel and one end of the universal plunger, more particularly illustrating a preferred technique for loading the universal plunger in one end of the pump barrel.
Figure 6:
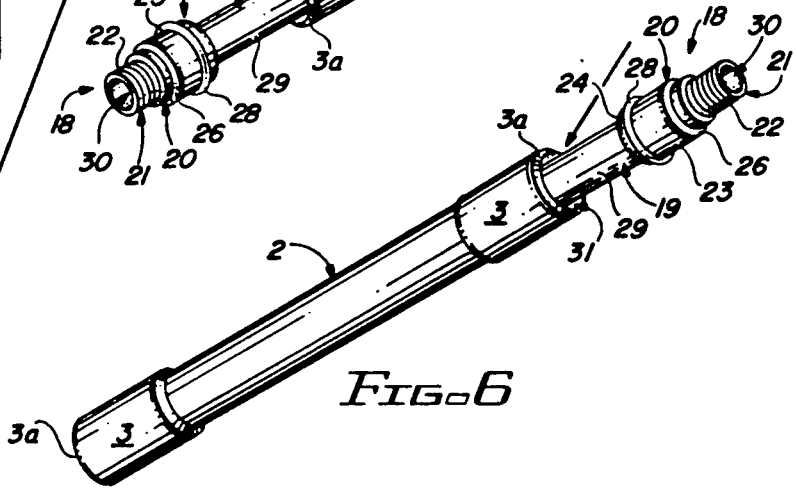
FIG. 6 is a perspective view of the pump barrel and the opposite end of the universal plunger projecting from the opposite end of the pump barrel, more particularly illustrating a preferred technique for introducing a "Teflon" resin-hydrocarbon composition into a lubrication chamber defined by the pump barrel and the plunger body and inner O-rings of the universal plunger.

Referring now to FIG. 5 of the drawings, the universal plunger 18 is loaded in one end of the pump barrel 2 at the collar lip 3*a*, after placing an inside O-ring 28 on the inside O-ring seat 27 and an outside O-ring 26 on the outside O-ring seat 25 of one end of the plunger body 19 and inserting the opposite end of the plunger body 19 into the pump barrel bore 2*a* of the pump barrel 2. The universal plunger 18 is then forced entirely through the pump barrel bore 2*a* until the opposite, unsealed end of the universal plunger 18 projects from the opposite end of the pump barrel 2, as illustrated in FIG. 6. Another inside O-ring 28 is then placed on the vacant inside O-ring seat 27 and an outside O-ring 26 is seated in the empty outside O-ring 25 of the unsealed end of the universal plunger 18 projecting from the pump barrel bore 2*a*. The pump barrel 2 is then oriented in an upright, vertical position and the universal plunger 18 is slidably adjusted inside the pump barrel bore 2*a* until the projecting inside flange 24 is spaced slightly from the opposite collar lip 3*a* of the pump barrel 2, to facilitate observation of the annular lubrication chamber 31, which is defined by that portion of the plunger barrel 29 which extends between the inside flanges 24 and the inside surface of the pump barrel 2, as further illustrated in FIG. 6. A "Teflon"-hydrocarbon composition is then poured into the lubrication chamber 31 as indicated by the arrow, until the level of the "Teflon"-hydrocarbon composition rises to the collar lip 3*a*. The universal plunger 18 is then forced farther downwardly into the pump barrel bore 2*a* of the pump barrel 2 until the outside O-ring 26 and the inside O-ring 28 are sealed inside the pump barrel bore 2*a* and the tubing pump 1 is ready for operation. Reciprocation of the universal plunger 18 inside the pump barrel bore 2*a* of the pump barrel 2 thus causes the "Teflon" element of the "Teflon"-hydrocarbon composition to coat the inside walls of the pump barrel 2, thus lubricating and sealing the universal plunger 18 inside the pump barrel 2 while the tubing pump 1 is operating.

In a most preferred embodiment of the invention the "Teflon"-hydrocarbon composition utilized as a liquid seal and lubricating material in the universal plunger 18 is a polytetrafluorethylene, or "Teflon"-containing oil manufactured by PetroLon, Inc., under the trademark, "Slick 50". The "Slick 50" PTFE resin was designed as an engine treatment to coat the internal operating surfaces of engines and reduce engine friction. The material lowers engine operating temperature and increases lubrication, performance, horsepower and gas mileage. The key ingredient in the "Slick 50" PTFE resin coating is a suspension of polytetrafluorethylene ("Teflon") in oil. The "Teflon" ingredient forms a dry film and bonds to the porous metal surfaces of the universal plunger 18 and the inside surfaces of the pump barrel 2, to tightly seal the universal piston 18 inside the pump barrel 2 in reciprocating relationship, thereby preventing "blow back" of production fluid, a phenomenon which is characteristic of conventional tubing and insert pumps used for pumping oil wells.

Although the "Slick 50" product is highly suitable for use with the universal plunger 18 of this invention, it will be appreciated by those skilled in the art that other "Teflon" suspension compositions may operate to achieve the desired sealing and lubricating results, according to the knowledge of those skilled in the art.

Referring again to FIGS. 2–6 of the drawings, it will be further appreciated by those skilled in the art that although the outside O-ring 26 and inside O-ring 28 are installed on both ends of the plunger body 19 of the universal plunger 18, a single O-ring, or more than two O-rings may also be used on each end of the plunger body 19, as desired. In a most preferred embodiment of the invention the outside O-rings 26 and inside O-rings 28 are each characterized by polyurethane, combination high-pressure and wiper seals manufactured by the A. W. Chesterton Company under the trademark, "Super Mono Wiper Seal". Specifically, the "Super Mono Wiper Seal", style 10,000, has been found to be a superior product for sealing the top and bottom of the universal plunger 18 and maintaining the "Slick 50" "Teflon"-hydrocarbon composition in the lubrication chamber 31.

It will be appreciated by those skilled in the art that the universal plunger 18 of this invention can be constructed of any suitable material, including an aluminum-bronze alloy, or stainless steel, in non-exclusive particular, as well as like materials commonly used in insert and tubing pumps designed for oil well applications. It is further understood that the universal plunger 18 can be manufactured of any desired size to fit the pump barrels 2 of any conventional tubing or insert pump. Accordingly, referring again to FIG. 1, since the universal plunger 18 replaces the conventional soft packed plunger 7 in the tubing pump 1, the flange nipples 21 are threaded into the respective travelling valves 8, to ready the universal plunger 18 for insertion in the pump barrel bore 2*a* of the pump barrel 2. The standing valve puller 15 may also be attached to the bottom travelling valve 8, if so desired, and the universal plunger 18 operated in the tubing pump 1 in conventional fashion. The universal plunger 18 can also be constructed of any desired overall length, the plunger barrel length measured between the respective inside flanges 24 can be of any desired dimension and the plunger body 19 constructed to any appropriate diameter to shape a lubrication chamber 31 of desired volume. Moreover, tests have indicated that the universal plunger 18 will perform in a conventional tubing pump or insert pump of corresponding size at any desired pumping rate, for example, from one to about twenty strokes strokes per minute, or greater. Ordinarily, tubing and insert pumps operate at a pumping rate of about 10–12 strokes per minute and tests have further shown that the universal plunger 18 needs little maintenance and performs at an efficiency of up to 100% to seal the inside flanges 24 by operation of the internal "Teflon"-hydrocarbon composition.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A universal plunger disposed for sealing reciprocation in the barrel of an oil well pump, said universal plunger comprising an elongated plunger body having a longitudinal bore; a first bevel provided on one end of said plunger body; at least one first seal seat provided on said one end of said plunger body and terminating said first bevel and a first polyurethane combination high pressure and wiper seal provided in said first seal seat for sealing said one end of said plunger body in said barrel; a second bevel provided on the opposite end of said plunger body, said first bevel and said second bevel spaced to define a continuous liquid annulus along the length of the barrel corresponding to the length of said plunger body between said first bevel and said second bevel; at least one second seal seat provided on said opposite end of said plunger body and terminating said second bevel and a second polyurethane combination high pressure and wiper seal provided in said second seal seat for sealing said opposite end of said plunger body in said barrel; and a polytetrafluorethylene-hydrocarbon liquid disposed in the barrel of the pump between said first polyurethane combination high pressure and wiper seal and said second polyurethane combination high pressure and wiper seal for further sealing said universal plunger in said barrel.

2. The universal plunger of claim 1 wherein said at least one first seal seat further comprises a pair of first seal seats disposed in spaced relationship on said one end of said plunger body; said at least one first polyurethane combination high pressure and wiper seal further comprises a pair of first polyurethane combination high pressure and wiper seals disposed in said seal seats in sealing relationship, respectively; said at least one second seal seat further comprises a pair of second seal seats disposed in spaced relationship on said opposite end of said plunger body; and said at least one second polyurethane combination high pressure and wiper seal further comprises a pair of second polyurethane combination high pressure and wiper seals disposed in said second seal seats in sealing relationship, respectively.

3. The universal plunger of claim 2 wherein the oil well pump includes a top travelling valve and further comprising a first threaded nipple provided on said one end of said plunger body for threadable attachment to the top travelling valve.

4. The universal plunger of claim 3 wherein the oil well pump includes a bottom travelling valve and further comprising a second threaded nipple provided on said opposite end of said plunger body for threadable attachment to the bottom travelling valve.

5. The universal plunger of claim 4 wherein said "Teflon"-containing liquid further comprises a hydrocarbon-Teflon composition.

6. A universal plunger for mounting in the barrel of an oil well pump in reciprocating, sealing relationship, which barrel is adapted to receive a first travelling valve and a second travelling valve spaced from said first travelling valve, said universal plunger comprising an elongated plunger body adapted for disposition in the barrel between the first travelling valve and the second travelling valve; a first bevel provided on one end of said plunger body; at least one first seal seat provided in said one end of said plunger body and terminating said first bevel and a first polyurethane combination high pressure and wiper seal seated in said first seal seat in liquid-sealing relationship; a second bevel provided on the opposite end of said plunger body, said first bevel and said second bevel spaced to define a continuous liquid annulus along the length of the barrel corresponding to the length of said plunger body between said first bevel and said second bevel; at least one second seal seat provided in said opposite end of said plunger body and terminating said second bevel and a second polyurethane combination high pressure and wiper seal seated in said second seal seat in liquid-sealing relationship; an oil-containing suspended polytetrafluorethylene disposed in the barrel between said first polyurethane combination high pressure and wiper seal and said second polyurethane combination high pressure and wiper seal for further sealing said universal plunger in said barrel.

7. The universal plunger of claim 6 wherein said at least one first seal seat further comprises a pair of first seal seats disposed in spaced relationship on said one end of said plunger body; said at least one first polyurethane combination high pressure and wiper seal further comprises a pair of first polyurethane combination high pressure and wiper seals disposed in said seal seats, respectively; said at least one second seal seat further comprises a pair of second seal seats disposed in spaced relationship on said opposite end of said plunger body; and said at least one second polyurethane combination high pressure and wiper seal further comprises a pair of second polyurethane combination high pressure and wiper seals disposed in said second seal seats in sealing relationship, respectively.

* * * * *